US011166546B2

(12) United States Patent
Lin

(10) Patent No.: US 11,166,546 B2
(45) Date of Patent: Nov. 9, 2021

(54) HEIGHT ADJUSTABLE DESK DRIVEN BY SINGLE MOTOR

(71) Applicants: HI-MAX INNOVATION CO., LTD., Taichung (TW); Yi Chen Tseng, Taichung (TW)

(72) Inventor: Jhih Fan Lin, Taichung (TW)

(73) Assignees: Yi Chen Tseng, Taichung (TW); HI-MAX INNOVATION CO., LTD., Taichung (TW)

( * ) Notice: Subject to any disclaimer, the term of this patent is extended or adjusted under 35 U.S.C. 154(b) by 0 days.

(21) Appl. No.: 16/730,633

(22) Filed: Dec. 30, 2019

(65) Prior Publication Data

US 2021/0145163 A1 May 20, 2021

(30) Foreign Application Priority Data

Nov. 18, 2019 (TW) ..... 108215260

(51) Int. Cl.
*A47B 9/04* (2006.01)
*A47B 9/20* (2006.01)
*A47B 21/02* (2006.01)

(52) U.S. Cl.
CPC ..... *A47B 9/04* (2013.01); *A47B 9/20* (2013.01); *A47B 21/02* (2013.01); *A47B 2009/043* (2013.01); *A47B 2009/046* (2013.01); *A47B 2200/0052* (2013.01); *A47B 2200/0057* (2013.01)

(58) Field of Classification Search
CPC .. A47B 9/04; A47B 9/20; A47B 21/02; A47B 2009/043; A47B 2009/046; A47B 2200/0052; A47B 2200/0057
USPC ..... 108/20
See application file for complete search history.

(56) References Cited

U.S. PATENT DOCUMENTS 2,368,748 A * 2/1945 Doty ..... A47B 9/04 108/147
3,259,081 A * 7/1966 Stalnacke ..... A47B 9/04 108/147
4,552,403 A * 11/1985 Yindra ..... A61G 13/02 108/147
4,615,279 A * 10/1986 de la Haye ..... A47B 9/04 108/147
4,714,025 A * 12/1987 Wallin ..... A47B 9/00 108/20
5,269,343 A * 12/1993 Trapp ..... F16K 31/502 137/554

(Continued)

FOREIGN PATENT DOCUMENTS

DE 20 2015 106 942 * 12/2015
WO WO 2009/039853 * 9/2008

*Primary Examiner* — Daniel J Troy
*Assistant Examiner* — Timothy M Ayres
(74) *Attorney, Agent, or Firm* — Wang Law Firm, Inc.

(57) ABSTRACT

A height adjustable desk includes a work surface, a first telescoping leg, a second telescoping leg, a driving device, and a switch device. The first telescoping leg and the second telescoping leg are connected to the work surface, and are driven by the driving device to lift or low the work surface to any desired height. The switch device is mounted on the first telescoping leg to be activated when the work surface is moved to a predetermined position. The switch device will turn the motor off to stop the work surface when the switch device is activated.

9 Claims, 5 Drawing Sheets

(56) References Cited

U.S. PATENT DOCUMENTS

| | | | | |
|---|---|---|---|---|
| 5,299,678 | A * | 4/1994 | Chang | E05F 15/668 192/141 |
| 5,901,610 | A * | 5/1999 | Schneider | F16H 1/08 74/421 A |
| 6,286,441 | B1 * | 9/2001 | Burdi | A47B 9/00 108/147 |
| 6,321,611 | B1 * | 11/2001 | Szu | F16H 25/2015 192/141 |
| 6,478,269 | B2 * | 11/2002 | Forsberg | A47B 9/00 108/147.19 |
| 7,482,544 | B2 * | 1/2009 | Gong | A61G 5/14 200/1 V |
| 7,908,981 | B2 * | 3/2011 | Agee | A47B 9/04 108/147 |
| 8,358,096 | B2 * | 1/2013 | Bastholm | F16H 25/2015 318/626 |
| 8,640,562 | B2 * | 2/2014 | Pettersson | F16H 25/2015 74/89.37 |
| 9,236,817 | B2 * | 1/2016 | Strothmann | A47B 9/20 |
| 9,723,916 | B2 * | 8/2017 | Chen | A47B 9/04 |
| 9,848,696 | B2 * | 12/2017 | Tseng | A47B 9/04 |
| 10,588,401 | B1 * | 3/2020 | Lu | A47B 9/04 |
| 2005/0160846 | A1 * | 7/2005 | Chiang | F16H 25/20 74/89.35 |
| 2007/0169578 | A1 * | 7/2007 | Christensen | F16H 25/2021 74/89.37 |
| 2008/0289544 | A1 * | 11/2008 | Buitmann | A47B 9/00 108/20 |
| 2009/0121100 | A1 * | 5/2009 | Waidelich | A47B 9/04 248/188.4 |
| 2014/0020606 | A1 * | 1/2014 | Benden | A47B 97/00 108/50.14 |

* cited by examiner

HEIGHT ADJUSTABLE DESK DRIVEN BY SINGLE MOTOR

BACKGROUND OF THE INVENTION

1. Technical Field

The present invention relates to office furniture, and more particularly to a height adjustable desk driven by single motor.

2. Description of Related Art

Typically, a conventional desk usually has a fixed height, and it can't fit people with different heights. In present days, height adjustable desks were brought in the present market. An improved height adjustable desk is able to elevate its work surfaces to a position that a user has to stand up to work on the work surface. With this design, it can prevent the user from sitting for a long time by changing a height of the work surface every predetermined time.

BRIEF SUMMARY OF THE INVENTION

In view of the above, the primary objective of the present invention is to provide a height adjustable desk, which is driven by single motor to move the work surface to any height.

In order to achieve the objective of the present invention, a height adjustable desk includes a work surface; a first telescoping leg including a first base, a first upper tubular member, and a first lower tubular member, wherein the first base is connected to the work surface; an end of the first upper tubular member is connected to the first base, and the first lower tubular member movably engages the first upper tubular member; a first screw assembly including a first screw and a first nut, wherein the first nut is fixed to the first lower tubular member and is attached to the first screw; the screw has opposite ends extending to the first base and the first lower tubular member respectively; a first gear assembly connected to the first screw of the first screw assembly; a driving device connected to the first screw assembly to turn the first screw of the first screw assembly through the first gear assembly; and a switch device mounted on the first upper tubular member of the first telescoping leg and electrically connected to the driving device. The first nut activates the switch device to turn the driving device off when the work surface is moved to a predetermined position.

In an embodiment, the first gear assembly has a first driving gear and a first driven gear, wherein the first driven gear is received in the first base and connected to the first screw of the first screw assembly; the first driving gear is turned by the driving device and meshed with the first driven gear.

In an embodiment, the first base has a first space, in which the first gear assembly is received.

In an embodiment, the driving device is mounted on an upper surface of the first upper tubular member.

In an embodiment, the height adjustable desk further includes a second telescoping leg including a second base, a second upper tubular member, and a second lower tubular member, wherein the second base is connected to the work surface; an end of the second upper tubular member is connected to the second base, and the second lower tubular member movably engages the second upper tubular member; a second screw assembly including a second screw and a second nut, wherein the second nut is fixed to the second lower tubular member and is attached to the second screw; the screw has opposite ends extending to the second base and the second lower tubular member respectively; a second gear assembly connected to the second screw of the second screw assembly; and a transverse frame connected to the work surface and having opposite ends connected to the first base of the first telescoping leg and the second base of the second telescoping leg respectively; wherein the driving device includes a motor and a driving shaft connected to the motor; the motor is connected to the first upper tubular member, and the driving shaft is received in the transverse frame and connected to the first gear assembly and the second assembly.

In an embodiment, the second gear assembly has a second driving gear and a second driven gear, wherein the second driven gear is received in the second base and connected to the second screw of the second screw assembly; the second driving gear is turned by the driving device and meshed with the second driven gear.

In an embodiment, the driving shaft of the driving device passes through the first driving gear and the second driving gear respectively.

In an embodiment, the second base has a second space, in which the second gear assembly is received.

In an embodiment, the switch device has a microswitch.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
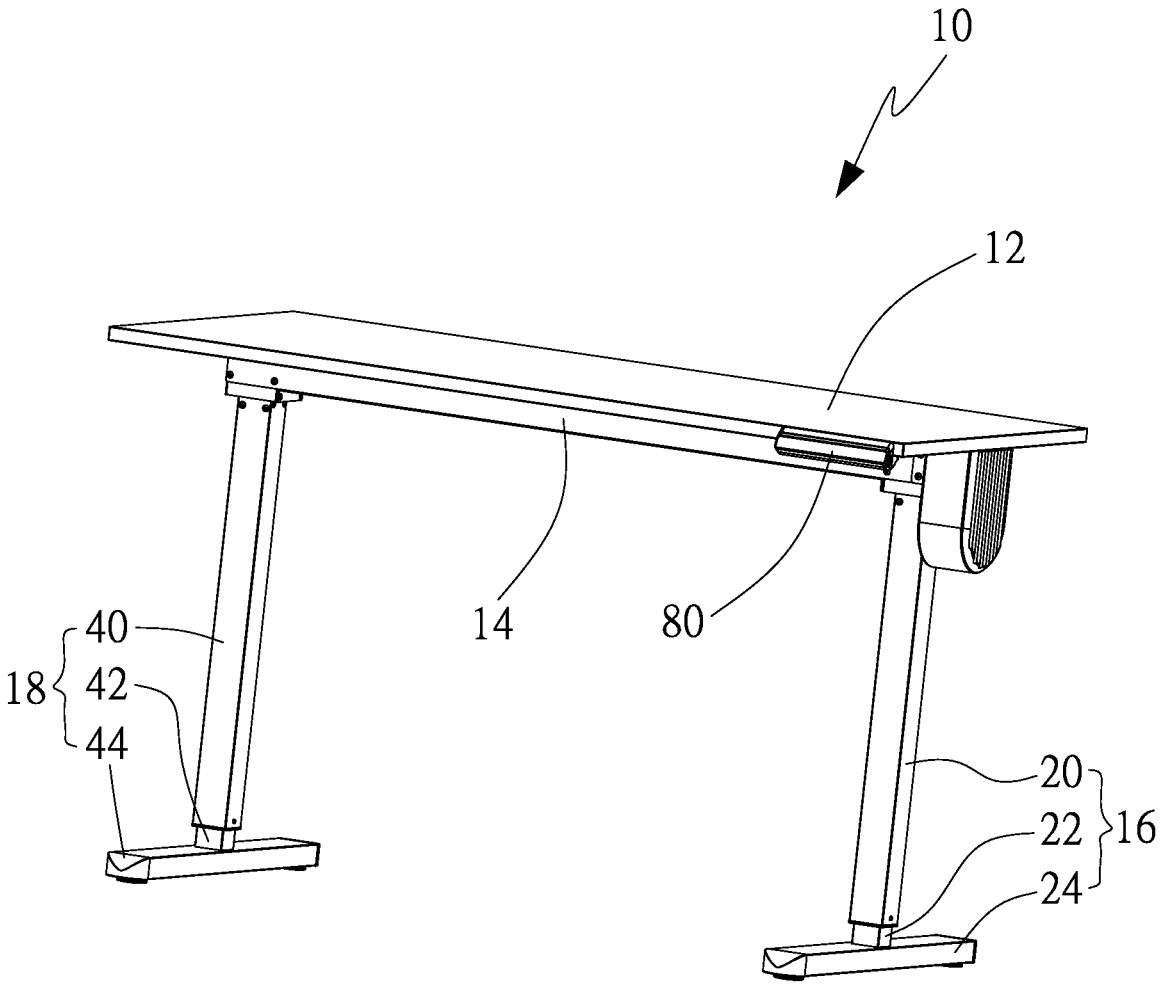
FIG. 1 is a perspective view of a first preferred embodiment of the present invention.

FIG. 1 shows a height adjustable desk 10 of the first preferred embodiment of the present invention, including a work surface 12, a transverse frame 14, a first telescoping leg 16 and a second telescoping leg 18. The transverse frame 14 is connected to a bottom side of the work surface 12, and the first telescoping leg 16 and the second telescoping leg 18 are connected to the transverse frame 14 with a predetermined distance therebetween. The first telescoping leg 16 includes a first upper tubular member 20, a first lower tubular member 22, and a first base 24. The base 24 is connected to an end of the first lower tubular member 22.

The second telescoping leg 18 includes a second upper tubular member 40, a second lower tubular member 42, and a second base 44. The base 44 is connected to an end of the second lower tubular member 42. The transverse 14 has an end connected to an end of the first upper tubular member 20 and the other end connected to an end of the second tubular member 40.

Figure 2:
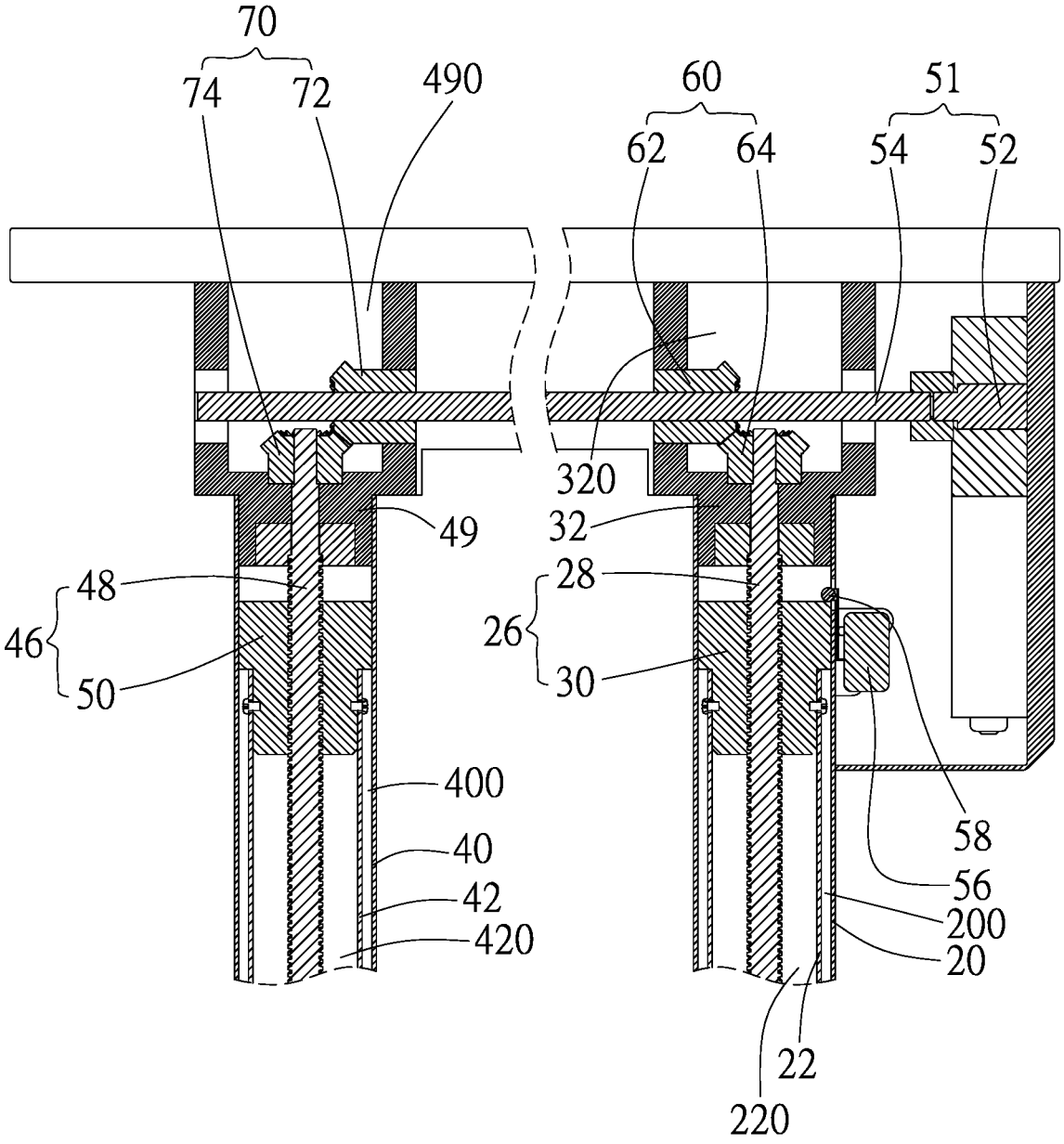
FIG. 2 is a sectional view in part of the first preferred embodiment of the present invention.

As shown in FIG. 2, the first upper tubular member 20 has a first channel 200 therein, and the first lower tubular member 22 has a first tunnel 220 therein. The first lower tubular member 22 is movably received in the first channel 200 of the first upper tubular member 20. A first fixed member 32 is connected to an end of the first upper tubular member 20 and has a first space 320 therein.

A first screw assembly 26 includes a first screw 28 and a first nut 30. The nut 30 is connected to an end of the first lower tubular member 22 and has a portion extending to the first tunnel 220 of the first lower tubular member 22. The nut 30 is attached to the screw 28, and then the screw 28 is connected to the first fixed member 32. The first screw 28 has an end extending into the first tunnel 220 of the first lower tubular member 22 and has a free end to let the first screw 28 free to move.

A driving device 51 has a motor 52 and a driving shaft 54. The motor 52 is mounted on an upper surface of the first upper tubular member 20, and the driving shaft 54 is received in the transverse frame 14 and has an end connected to the motor 52. A switch device 56 is mounted on the upper side of the first upper tubular member 20 and electrically connected to the motor. The switch device 56 has a switch 58 to be operated to turn the motor 52 on or off. The switch 58 is received in the first channel 200 of the first upper tubular member 20 and associated with the first nut 30.

A first gear assembly 60 includes a first driving gear 62 and a first driving driven gear 64. The first driving gear 62 is received in the first space 320 of the first fixed member 32. The driving shaft 54 passes through and connects the first driving gear 62, so that the motor 52 may drive the first driving gear 62 to turn. The first driven gear 64 is connected to the first screw 28 and received in the first space 320 of the first fixed member 32 to mesh with the driving gear 62.

The second upper tubular member 40 has a second channel 400 therein, and the second lower tubular member 42 has a second tunnel 420 therein. The second lower tubular member 42 is movably received in the second channel 400 of the second upper tubular member 40. A second fixed member 49 is connected to an end of the second upper tubular member 40.

A second screw assembly 46 includes a second screw 48 and a second nut 50. The nut 50 is connected to an end of the second lower tubular member 42. The nut 30 is attached to the screw 48, and then the screw 48 is connected to the second fixed member 49. The second screw 48 has an end extending into the second tunnel 420 of the second lower tubular member 42 and has a free end to let the second screw 48 free to move.

A second gear assembly 70 includes a second driving gear 72 and a second driving driven gear 74. The second driving gear 72 is received in a second space 490 of the second fixed member 49. The driving shaft 54 passes through and connects the second driving gear 72, so that the motor 52 may drive both the first driving gear 62 and the second driving gear 72 to turn. The second driven gear 74 is connected to the second screw 48 and received in the second space 490 of the second fixed member 49 to mesh with the driving gear 72.

Figure 3:
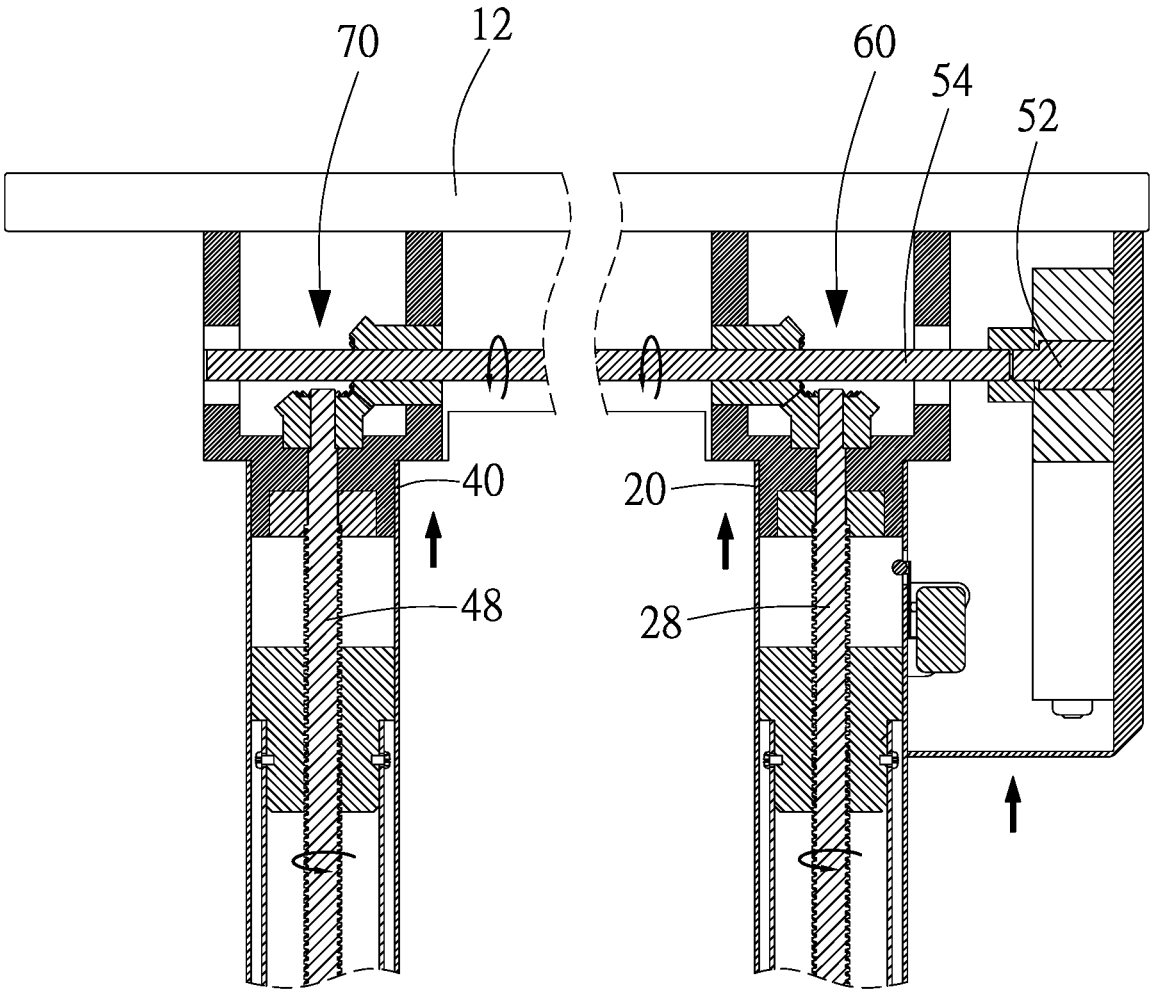
FIG. 3 is a sectional view in part of the first preferred embodiment of the present invention, showing the work surface being lifted.

As shown in FIG. 3, when the motor 52 is turned on to drive both the first and the second screws 28, 48 to turn synchronously through the driving shaft 54 and the first and the second upper tubular members 20, 48 will be moved upwardly or downwardly by the first and the second screws 28, 48 respectively.

Figure 4:
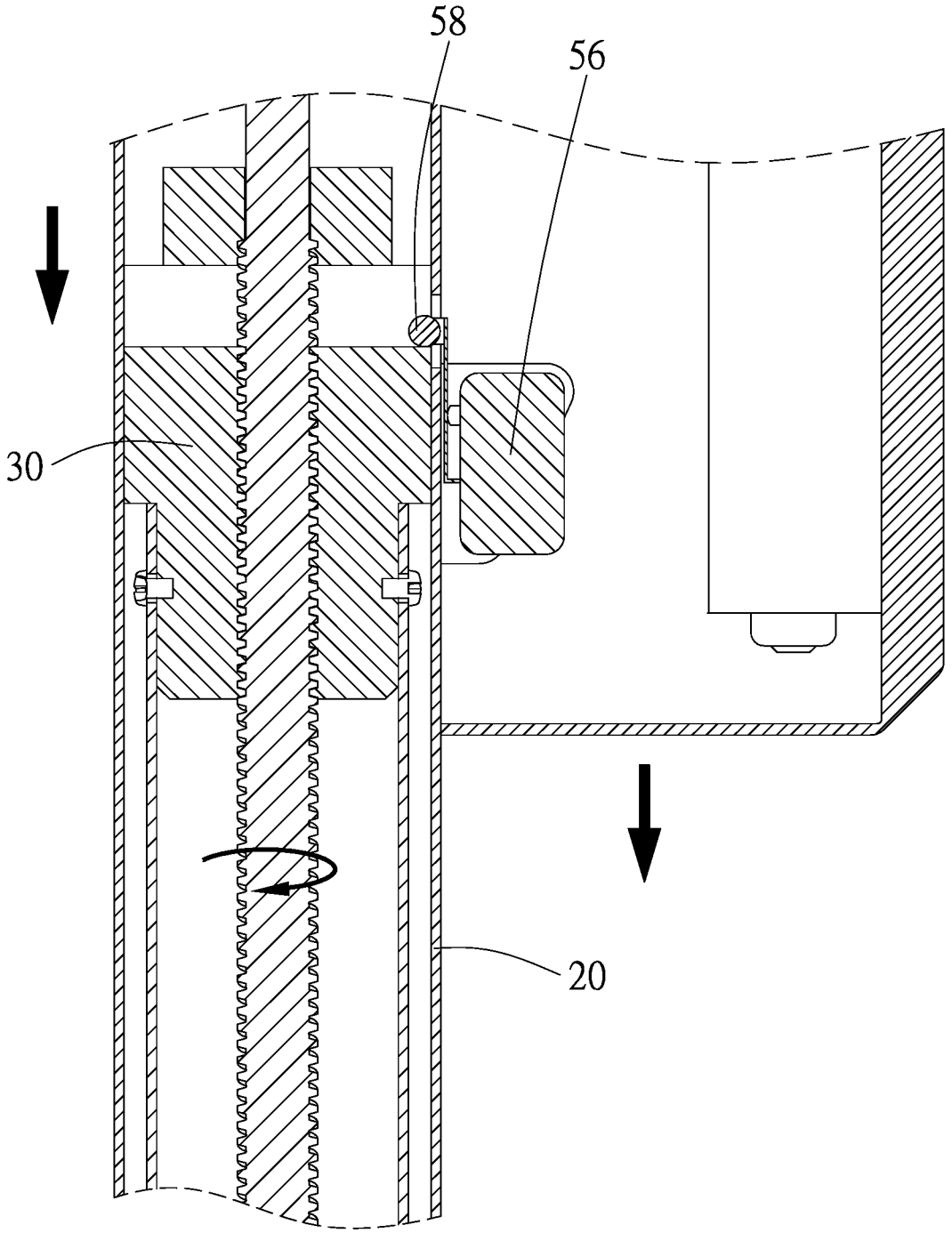
FIG. 4 is a sectional view in part of the first preferred embodiment of the present invention, showing the work surface being lowered.

As shown in FIG. 4, when the first upper tubular member 20 is lowered to a predetermined position for the switch 58 of the switch device 56 touching the first nut 30, the switch device will be turned off to cut the power to the motor 52 off. As a result, the motor 52 is stopped and the first and the second upper tubular members 20, 48 stay still. It is noted that when the motor 52 is restarted manually, the switch device 56 will not cut the power. The switch 56 may be a microswitch, an optical switch or any equivalent device.

As shown in FIG. 1, the height adjustable desk of the first preferred embodiment of the present invention further includes a controlling box 80 mounted on the work surface 12 and electrically connected to the motor 52. The controlling box 80 includes several keys, such as up, down, memory, highest, and lowest, to be operated by user to control the motor 52 to lift or lower the work surface 12 to a desired position.

Figure 5:
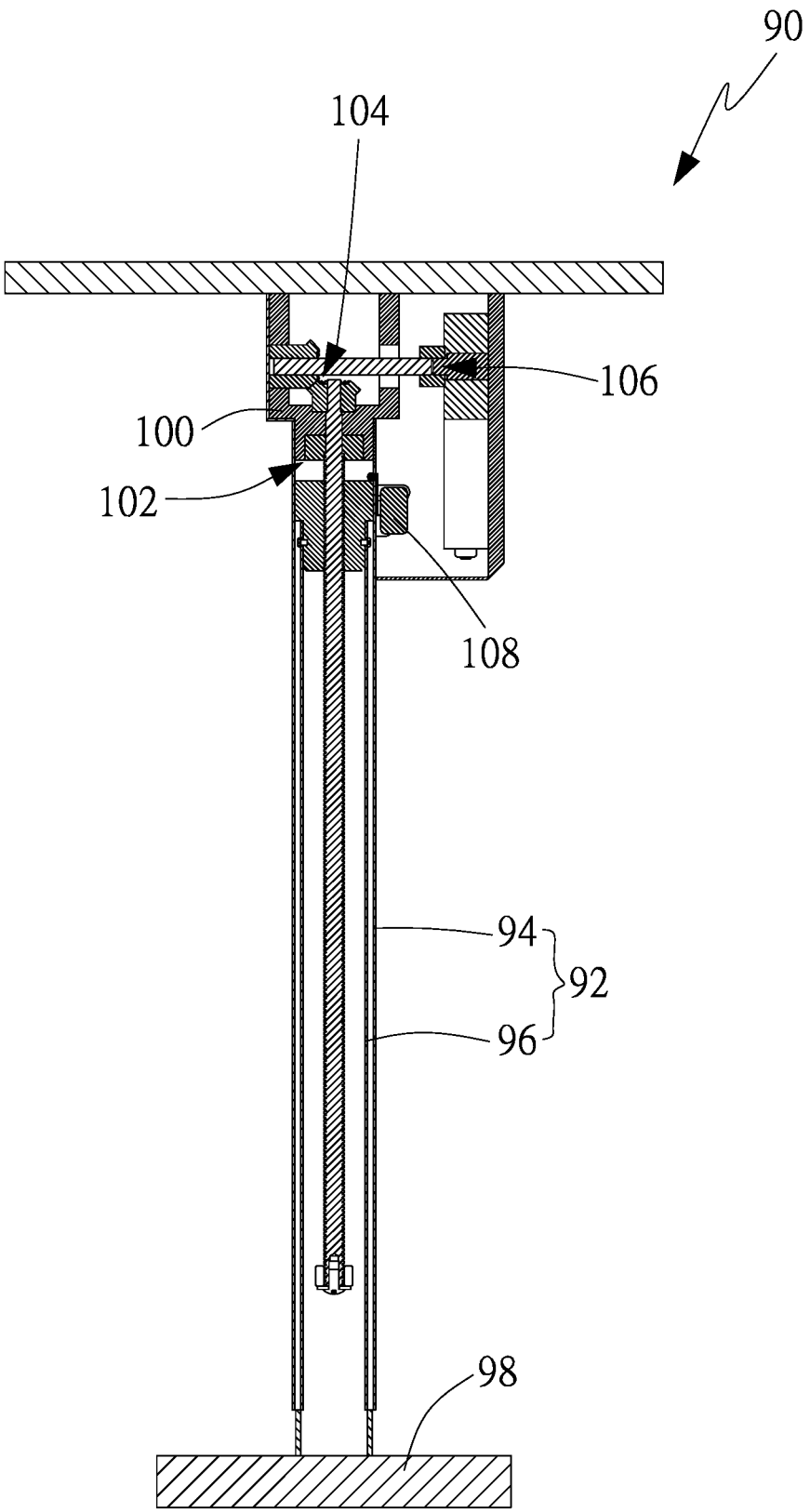
FIG. 5 is a sectional view in part of second preferred embodiment of the present invention.

FIG. 5 shows a first telescoping leg 92 of a height adjustable desk 90 of the second preferred embodiment of the present invention, including a first upper tubular member 94, a first lower tubular member 96, and a first base 98. The height adjustable desk of the second preferred embodiment of the present invention further includes a first fixed base 100, a first screw assembly 102, a first gear assembly 104, a driving device 106, and a switch device 108. In the second preferred embodiment, the height adjustable desk 90 only has one leg, i.e. the first telescoping leg 92.

In conclusion, user may operate the controlling box 80 to control the motor 52, and the motor 52 may lift or lower the work surface 12 to any desired position. The switch device 56 will turn off the motor 52 automatically when the work surface 12 is moved to the lowest position.

It must be pointed out that the embodiments described above are only some preferred embodiments of the present invention. All equivalent structures which employ the concepts disclosed in this specification and the appended claims should fall within the scope of the present invention.

What is claimed is:

1. A height adjustable desk, comprising:

a work surface;

a first telescoping leg including a first base, a first upper tubular member, and a first lower tubular member, wherein the first base is connected to the work surface; an end of the first upper tubular member is connected to the first base, and the first lower tubular member movably engages the first upper tubular member;

a first screw assembly including a first screw and a first nut, wherein the first nut is fixed to the first lower tubular member and is attached to the first screw; the screw has opposite ends extending to the first base and the first lower tubular member respectively;

a first gear assembly connected to the first screw of the first screw assembly;

a driving device connected to the first screw assembly to turn the first screw of the first screw assembly through the first gear assembly; and a switch device mounted on the first upper tubular member of the first telescoping leg and electrically connected to the driving device;

wherein the first nut activates the switch device to turn the driving device off when the work surface is moved to a predetermined position;

wherein the switch device is mounted on an outer surface of the first upper tubular member, and the switch device has a switch movably received in the first upper tubular member, whereby the switch moved by the first nut to activate the switch device when the work surface is moved to the predetermined position;

wherein the first upper tubular member has a bore, and the switch has a ball going into the first upper tubular member via the bore to contact the first nut.

2. The height adjustable desk of claim 1, wherein the first gear assembly has a first driving gear and a first driven gear, wherein the first driven gear is received in the first base and connected to the first screw of the first screw assembly; the first driving gear is turned by the driving device and meshed with the first driven gear.

3. The height adjustable desk of claim 1, wherein the first base has a first space, in which the first gear assembly is received.

4. The height adjustable desk of claim 1, wherein the driving device is mounted on an upper surface of the first upper tubular member.

5. The height adjustable desk of claim 2, further comprising:

a second telescoping leg including a second base, a second upper tubular member, and a second lower tubular member, wherein the second base is connected to the work surface; an end of the second upper tubular member is connected to the second base, and the second lower tubular member movably engages the second upper tubular member;

a second screw assembly including a second screw and a second nut, wherein the second nut is fixed to the second lower tubular member and is attached to the second screw; the screw has opposite ends extending to the second base and the second lower tubular member respectively;

a second gear assembly connected to the second screw of the second screw assembly; and a transverse frame connected to the work surface and having opposite ends connected to the first base of the first telescoping leg and the second base of the second telescoping leg respectively;

wherein the driving device includes a motor and a driving shaft connected to the motor; the motor is connected to the first upper tubular member of the first telescoping leg, and the driving shaft is received in the transverse frame and connected to the first gear assembly and the second assembly.

6. The height adjustable desk of claim 5, wherein the second gear assembly has a second driving gear and a second driven gear, wherein the second driven gear is received in the second base and connected to the second screw of the second screw assembly; the second driving gear is turned by the driving device and meshed with the second driven gear.

7. The height adjustable desk of claim 6, wherein the driving shaft of the driving device passes through the first driving gear and the second driving gear respectively.

8. The height adjustable desk of claim 5, wherein the second base has a second space, in which the second gear assembly is received.

9. The height adjustable desk of claim 1, wherein the switch has a microswitch.

* * * * *